US007253371B1

(12) United States Patent
Kuo

(10) Patent No.: US 7,253,371 B1
(45) Date of Patent: Aug. 7, 2007

(54) NORMALLY CLOSED (ON) SWITCH WITH AN ON-OFF FIXED STRUCTURE

(76) Inventor: Chao-Tung Kuo, 6F., No. 21, Sindogn St., Songshan Dictrict, Taipei City 105 (TW)

( * ) Notice: Subject to any disclaimer, the term of this patent is extended or adjusted under 35 U.S.C. 154(b) by 0 days.

(21) Appl. No.: 11/497,438

(22) Filed: Aug. 2, 2006

(51) Int. Cl.
*H01H 13/14* (2006.01)

(52) U.S. Cl. ..... 200/520; 200/341; 200/564

(58) Field of Classification Search ..... 200/520, 200/17 R, 43.08, 523–526, 537, 564, 566, 200/330, 334, 341
See application file for complete search history.

(56) References Cited

U.S. PATENT DOCUMENTS 4,064,381 A * 12/1977 Mullen et al. ..... 200/16 A
5,304,753 A * 4/1994 Parrish et al. ..... 200/16 B
6,180,899 B1 * 1/2001 Passow ..... 200/243
6,198,058 B1 * 3/2001 Graninger et al. ..... 200/50.02
6,483,061 B1 * 11/2002 Harvey et al. ..... 200/532
6,822,173 B1 * 11/2004 Schafer ..... 200/16 A

* cited by examiner

*Primary Examiner*—K. Lee
(74) *Attorney, Agent, or Firm*—Birch, Stewart, Kolasch & Birch, LLP

(57) ABSTRACT

A normally closed (on) switch with an on-off fixed structure comprises at the center a seat having a sleeve inside which a push part and an elastic component; a top cover provided on the seat, of which the center is formed with a piercing hole corresponding to the sleeve; a movable ring provided in the hole, of which one end is formed with a flange around that is provided with a guidance groove corresponding to each pillar, and inside which more than one recessed portions are formed; and a movable button provided in the ring and associated with the push part, of which one end is formed with a raised part corresponding to more than one recessed portion formed inside the fringe of ring and the other end is formed with a groove. The button is pushed, rotated at a certain angle, and released to enable and disable the switch.

3 Claims, 7 Drawing Sheets

NORMALLY CLOSED (ON) SWITCH WITH AN ON-OFF FIXED STRUCTURE

FIELD OF THE INVENTION

This invention relates to a normally closed (on) switch with an on-off fixed structure and particularly to a switch that may normally turns ON and OFF.

BACKGROUND OF THE INVENTION

Conventionally, in order to control the persons getting in and out of an office building, a magnetic-attraction door lock is generally installed on a door for the persons in and out. Also a sensor is provided outside the door, while a button switch (normally on) is provided inside the door. The button switch stays in a normal condition and is electrically looped with the magnetic-attraction door lock. When the button switch is pushed, the circuit is instantly at a power-off state; when a person enters, the magnetic-attraction door lock is disabled by means of magnetic card induction so that the magnetic-attraction door lock stays at a disable state to open the door. When the person is going out, s/he pushes the button switch to instantly power off and disable the magnetic-attraction door lock, thereby the magnetic-attraction door lock staying at a disable state. With an oil pressure device, the door automatically opens for the person to go out.

Although the button switch may be used to power off the magnetic-attraction door lock, the magnetic-attraction door lock may be disabled to stay at a disable state, which thus make the door open for the person to go out. However, after the person goes out, the door is automatically close because being provided with the oil-pressure shut device.

Thus, for the conventional button switch, when more persons pass in and out of the building through the door, for example, at the time of on duty and off duty, because the button of the switch cannot be firmly fixed, an electrical conduction part and an electrically conductive pad stays at the power-off state for long time. Thus, a person is requested to push the button of switch, in order for the power-off state to not make the electrical conduction part contact the electrically conductive pad, or alternatively an iron chain or a rope is used to fix the opened door, which, as a result, is inconvenient to a user. Accordingly, the conventional button-based normally closed (on) switch is impractical and does not satisfy the user.

SUMMARY OF THE INVENTION

Thus, it is an object of this invention that a button in the ring is used to enable and disable a switch.

In order to achieve the objective mentioned above, this invention is a normally closed (on) switch provided with an on-off fixed structure, comprising at the center a seat provided with a sleeve inside which a push part and an elastic component, in which a contact pad is provided on the push part and an electrically conductive pad contacting the contact pad is provided at two sides near the sleeve; a top cover provided on the seat, of which the center is formed with a piercing hole corresponding to the sleeve, in which at least a pillar is provided surrounding the hole nearby; a movable ring provided in the hole, of which one end is formed with a flange around that is provided with a guidance groove corresponding to each pillar, and inside which more than one recessed portions are formed; and a movable button provided in the ring and associated with the push part, of which one end is formed with a raised part corresponding to more than one recessed portion formed inside the fringe of ring and the other end is formed with a groove.

DETAILED DESCRIPTION OF THE PREFERRED EMBODIMENTS

Figure 1:
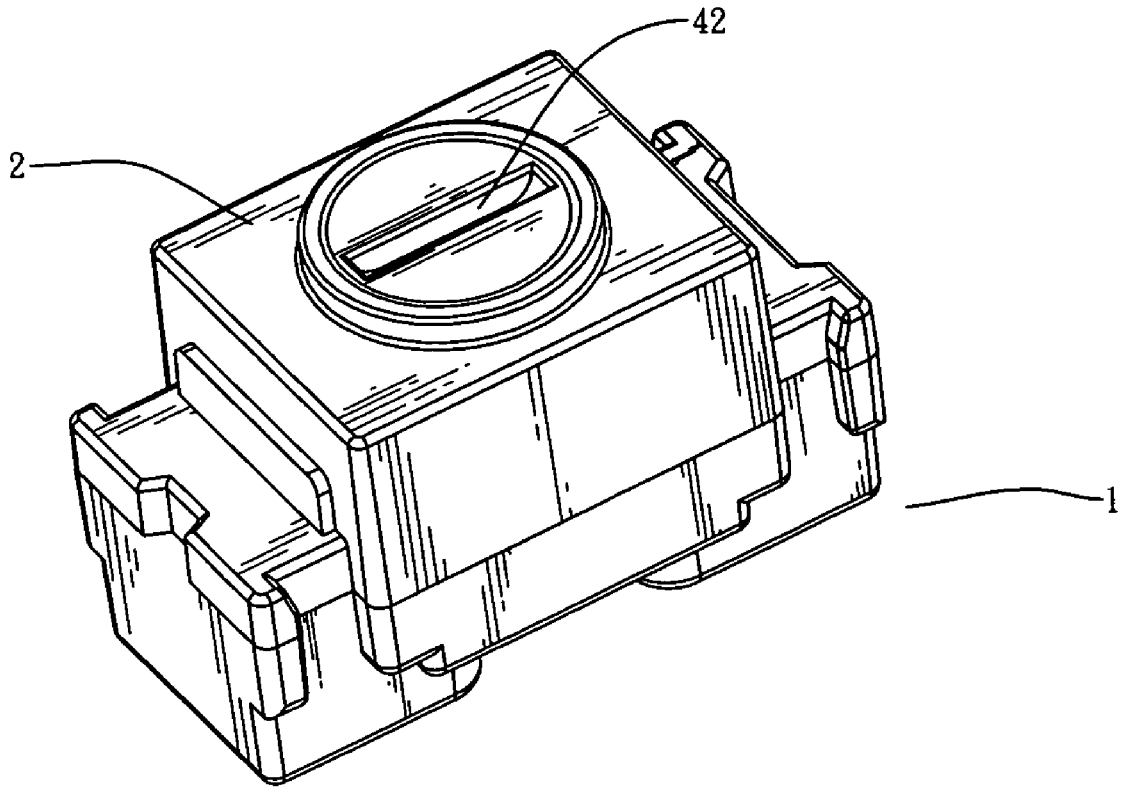
FIG. 1 is a 3D schematic view illustrating the appearance of this invention.
Figure 2:
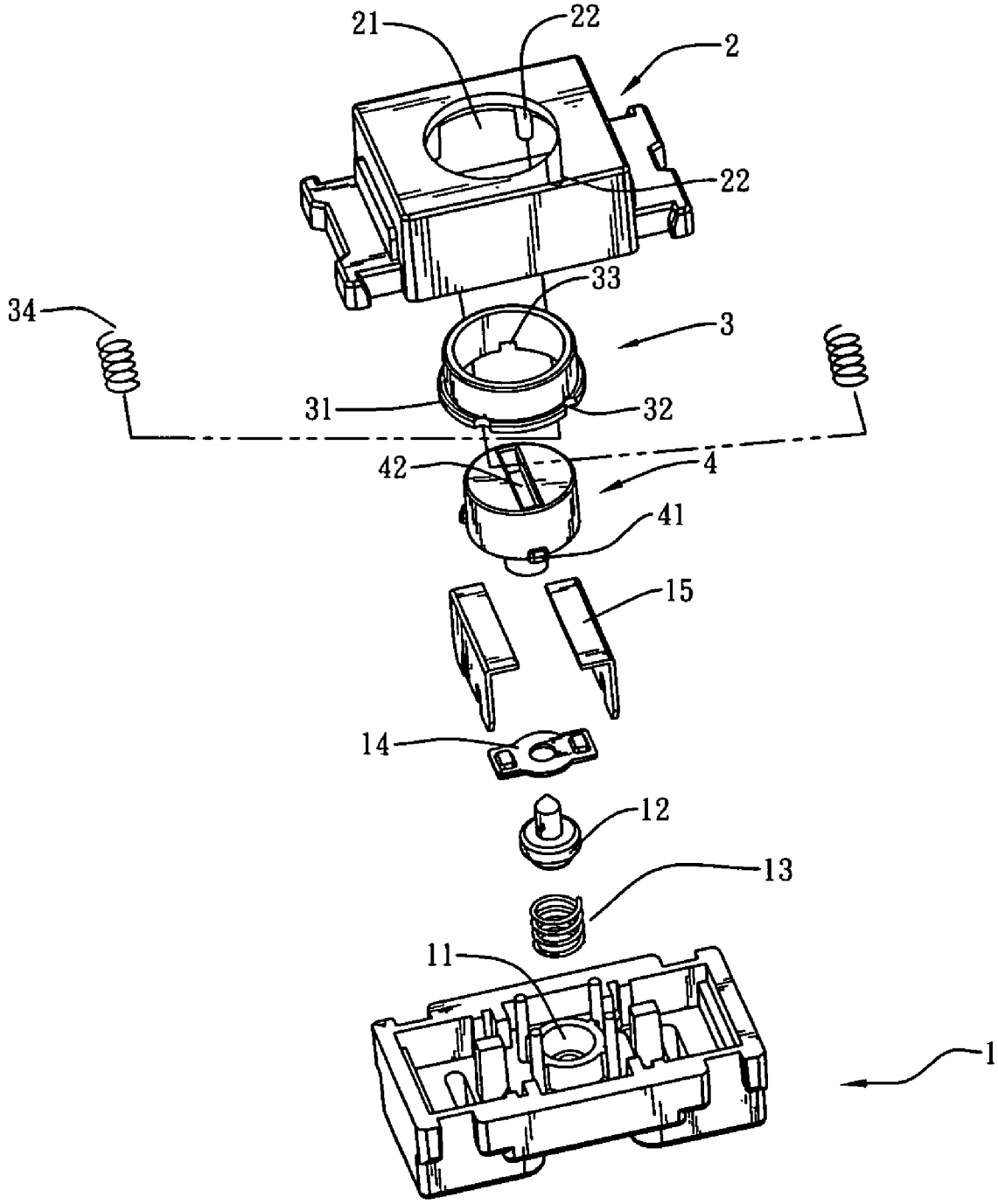
FIG. 2 is a 3D exploded view of this invention.
Figure 3:
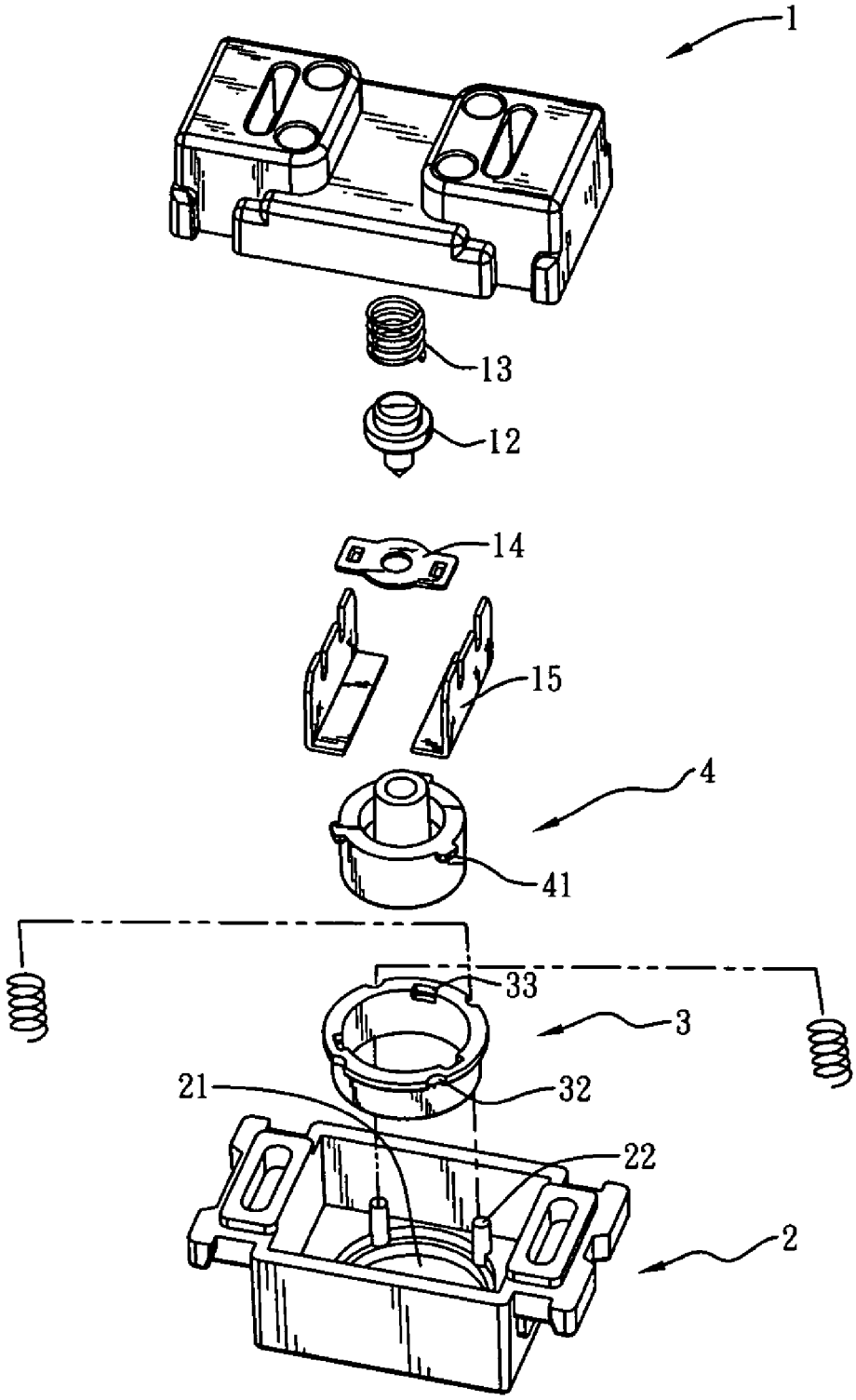
FIG. 3 is another 3D exploded view of this invention at another angle.

FIGS. 1, 2, and 3 are a 3D schematic view illustrating the appearance of this invention, a 3D exploded view of this invention, and another 3D exploded view of this invention at another angle, respectively. As shown in the figures, a normally closed (on) switch provided with an on-off fixed structure according to this invention is made up with a seat 1, a top cover 2, a ring 3, and a push part 4 and may be normally enabled or disabled with the push part 4 working with the ring 3.

The center of the seat 1 is formed with a sleeve 11 inside which a push part 12 is provided, in which an elastic component 13 is provided between the sleeve 11 and the push part 12, a contact pad 14 is provided on the push part 12, and two electrically conductive pads respectively contacting the contact pads are provided at two sides of the seat 1 near the sleeve 11.

The top cover 2 is arranged on the seat 1, of which the center is formed with a piercing hole 21 corresponding to the sleeve 11, in which at least a pillar 22 is provided surrounding the hole 21 nearby.

The ring 3 is movable up and down but cannot go round and round in the hole 21 formed in the top cover 2. A flange 31 is formed outside one end of the ring 3, which is provided with a guidance groove 32 corresponding to the pillar 22, and more than one recessed portion 33 are formed inside the fringe of ring. After the guidance groove 32 on the flange 31 of the ring 3 is set on each pillar 22, more than one elastic element 34 are set on each pillar 22, so one end of the elastic element 34 butts against the exterior of guidance groove of the flange 31 at a side of the ring 3 and the other end butts against a plane of each electrically conductive pad 15 on the seat 1.

The button 4 is movable provided in the ring 3 and joins with the push part 12, more than one raised part 41 corresponding to more than one recessed portion 33 of the ring 3 are provided along the outside of one end of the button 4, and the other end of the button 4 is formed with a groove 42. Accordingly, with the above-mentioned structure, the normally closed (on) switch provided with the on-off fixed structure is formed.

Figure 4:
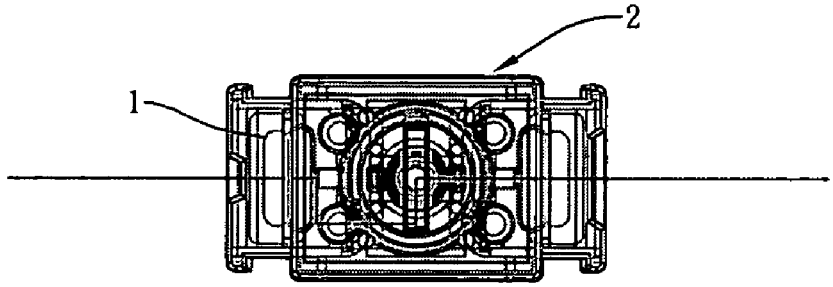
FIG. 4 is a top view illustrating a status of this invention.
Figure 5:
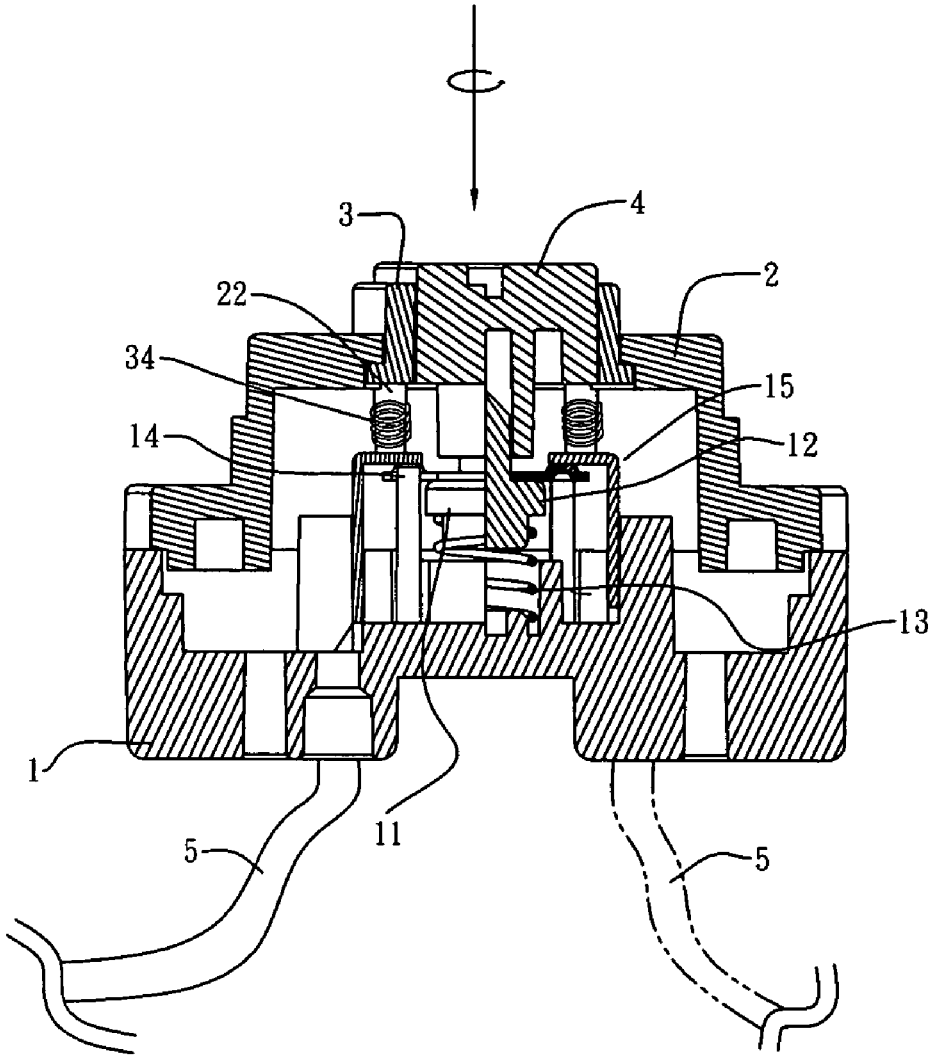
FIG. 5 is a sectional view illustrating a service condition A-A of this invention shown in FIG. 4.
Figure 6:
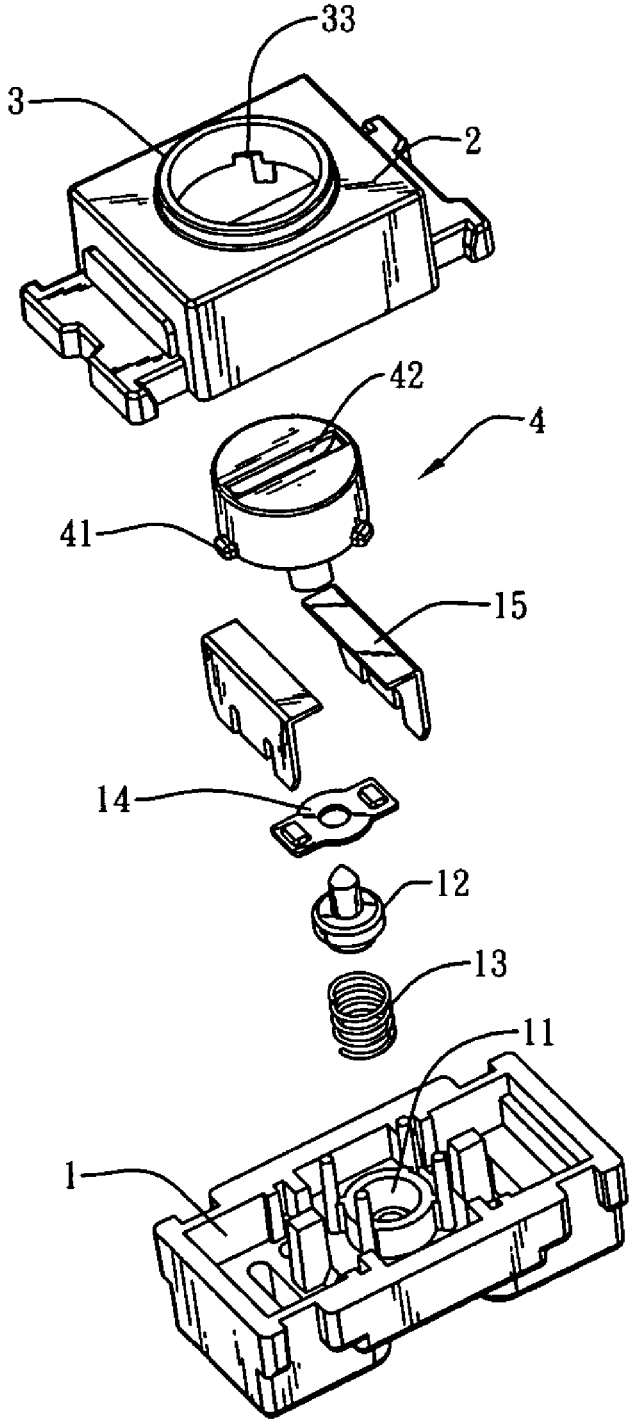
FIG. 6 is a 3D exploded view of another embodiment of this invention.
Figure 7:
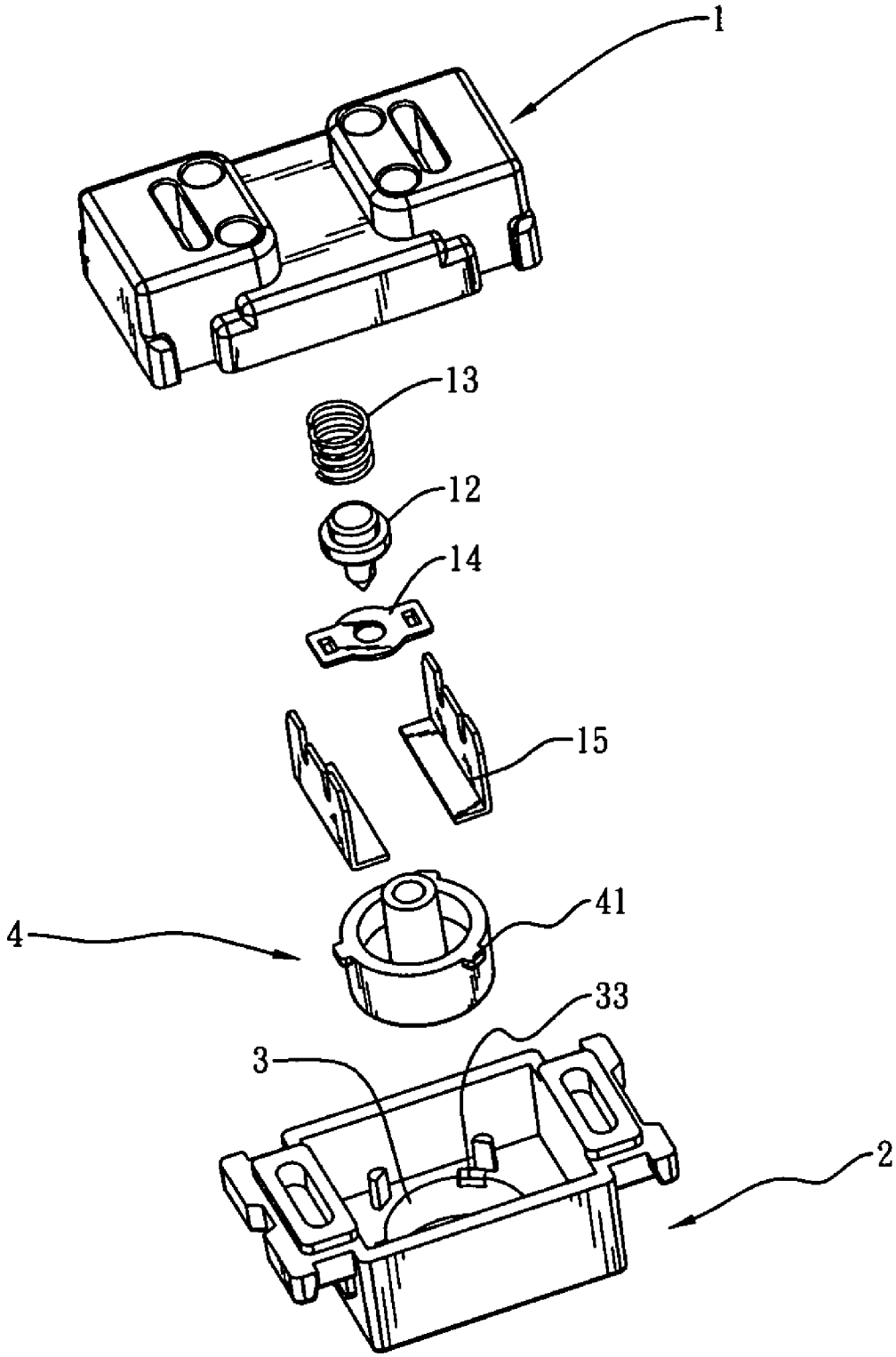
FIG. 7 is a 3D exploded view of another embodiment of this invention at another angle.

FIGS. 4 and 5 are a top view illustrating a status of this invention and a sectional view illustrating a service condition A-A of this invention shown in FIG. 4, respectively. As shown in the figures, when being used, the normally closed (on) switch according to this invention may be arranged on the wall at the inner side of a gate serving as the magnetic-attraction door lock for controlling the persons in and out of the building. When the switch is used, lead wires required may be connected from the bottom of seat 1 to each electrically conductive pad 15 so that the power source is transmitted through the lead wires 5 to each electrically conductive pad 15, and after the contact pads 14 are applied to contact each electrically conductive pad 15, an electrical loop is formed, thereby the switch being normally closed (on). If being provided with the magnetic-attraction door lock is matched, a door is normally closed (on); at this time, if the user want to open the door to go out, the user may simultaneously push the ring 3 and the button so that the ring 3 and the button 4 apply a downward force to push down the push part 12 and compress one end of the push part 12 and elastic elements 13 and 34 on the pillar 22, which makes the contact pad 14 on the push part 12 separate from the electrically conductive pad 15, and thereby due to power-off state, the magnetic-attraction door lock is disabled, so the user may open the door. When the user does not push the ring 3 and the button 4, the elastic elements 13 and 14 are released and then a recoil is generated to press back the ring 3 and the button 4 at the original state; thus, the contact pad 14 on the push part 12 is made to contact the electrically conductive pad 15, and thereby working with the magnetic-attraction door lock, the door is normally closed (on).

While opening the door, the user may also push the button 4 only to give a downward force to push down the push part 12 and compress the elastic element 13 at one end of the push part 12, and thus the contact pad 14 on the push part 12 is made to separate from the electrically conductive pad 15, and thereby due to the power-off state, the magnetic-attraction door lock is disabled so that the user may open the door. When the user does not push the button 4, the elastic element 13 is released and then a recoil is generated to press back the button 4 at the original state; thus, the contact pad 14 on the push part 12 is made to contact the electrically conductive pad 15, and thereby working with the magnetic-attraction door lock, the door is normally closed (on).

If the user wants to make the door open for long time, the user pushes the button 4 only to give a downward force to push down the push part 12 and compress the elastic element 13 at one end of the push part 12, and thus the contact pad 14 on the push part 12 is made to separate from the electrically conductive pad 15, thereby the power-off state occurring; at this time if the button 4 is enough pushed, more than one raised part 41 of the button 4 are fully separate from more than one recessed portion 33 of the ring 3; next, in the groove 42 on the side surface of button 4, by means of the user's fingernail or a tool, the button 4 is revolved at an angle and then released to make the raised part 41 of the button 4 presently revolve and then stop on the surface at the exterior side of a flange 31 at one end of the ring 3; thus, the button 4 is made to normally hold down the contact pad 14, which causes the contact pad 14 to separate from the electrically conductive pad 15, and thereby the magnetic-attraction door lock is disabled so that the user may open the door for long time. When being ready to close the door, the user revolves at an angle only the button 4 on the groove 42 at the end of the button 4; thus, after the raised part 41 of the button 4 rotates, it returns to more than one recessed portion 33 on the ring 3; the elastic element 13 is released and then a recoil is generated to press back the button 4 at the original state; thus, the contact pad 14 on the push part 12 is made to contact the electrically conductive pad 15, and thereby working with the magnetic-attraction door lock, the door is normally closed (on).

Figure 8:
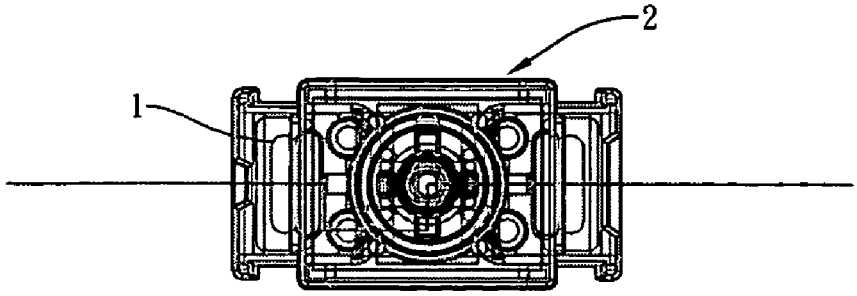
FIG. 8 is a top view illustrating a status of another embodiment of this invention.
Figure 9:
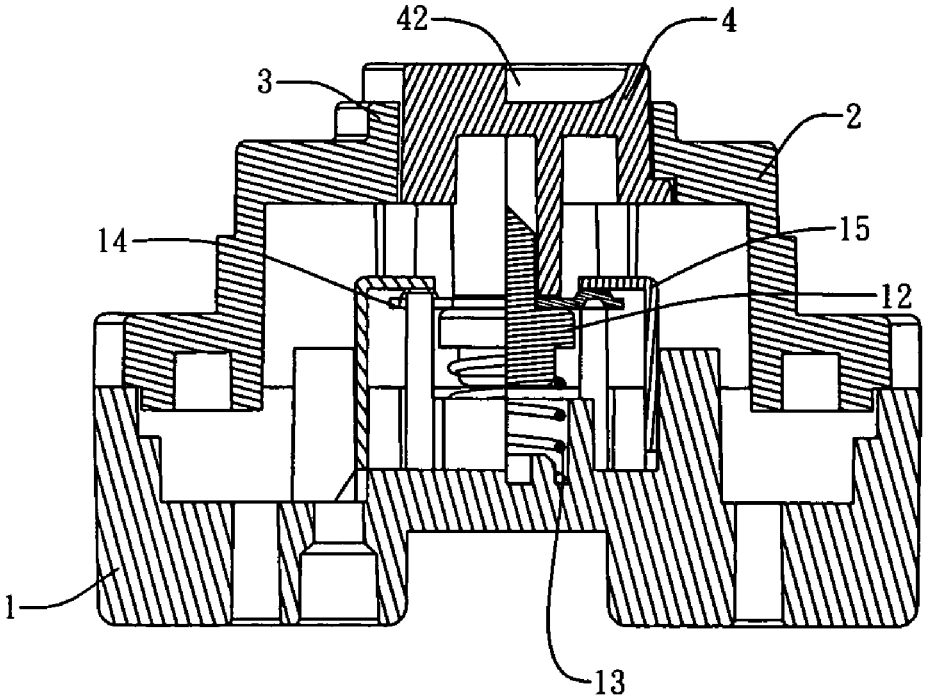
FIG. 9 is a sectional view illustrating a service condition B-B of this invention shown in FIG. 8.

FIGS. 6, 7, 8, and 9 are a 3D exploded view of another embodiment of this invention, a 3D exploded view of another embodiment of this invention at another angle, a top view illustrating a status of another embodiment of this invention, and a sectional view illustrating a service condition B-B of this invention shown in FIG. 8. As shown in the figures, being combined with each other for the action mentioned above, the ring 3 and the top cover 2 may also be joined into unity so that the ring 3 and the piercing hole 21 of top cover 2 are combined in one. more than one recessed portion 33 are formed inside the fringe of ring 3 so that the button 4 is movable provided in the ring 3 and joins with the contact pad 14 and the push part 12; also the raised parts 41 of the button 4 are corresponding to more than one recessed portion 33 of the ring 3 (the elastic element 34 shown in FIGS. 2 and 3 can thus be canceled). When it is used, the button 4 is just pushed by means of what mentioned above or pushed to an extent and then revolved at a certain angle for achievement of the same effects as those described above.

To sum up, this invention is the normally closed (on) switch provided with the on-off fixed structure and the button in the ring is used to enable and disable a switch, and further this invention is made to be improved and practical to meet the requirements of application for protection under patent law.

However, in the description mentioned above, only the preferred embodiments according to this invention are provided without limit to this invention and the characteristics of this invention; all those skilled in the art without exception should include the equivalent changes and modifications as falling within the true scope and spirit of the present invention.

What is claimed is:

1. A normally closed (on) switch with an on-off fixed structure, comprising:

a seat formed with a sleeve inside which a push part is provided, in which an elastic component is provided between the sleeve and the push part, a contact pad is provided on the push part, and two electrically conductive pads respectively contacting the contact pads are provided at two sides of the seat near the sleeve;

a top cover arranged on the seat, of which the center is formed with a piercing hole corresponding to the sleeve, in which at least a pillar is provided surrounding the hole nearby;

a ring being movable provided in the piercing hole of the top cover, in which a flange is formed outside one end of the ring and provided with a guidance groove corresponding to the pillar and more than one recessed portion are formed inside the fringe of ring; and a button being movable provided in the ring and being joined with the push part, in which more than one raised part corresponding to more than one recessed portion of the ring are provided along the outside of one end of the button and a groove is provided at the other end of the button.

2. A normally closed (on) switch with an on-off fixed structure according to claim 1, wherein more than one elastic element are set on the pillar of the top cover, and one end of the elastic element butts against the exterior of guidance groove of the flange at a side of the ring and the other end butts against the electrically conductive pad of the seat.

3. A normally closed (on) switch with an on-off fixed structure, comprising:

a seat formed with a sleeve inside which a push part is provided, in which an elastic component is provided between the sleeve and the push part, a contact pad is provided on the push part, and two electrically conductive pads respectively contacting the contact pads are provided at two sides of the seat near the sleeve;

a top cover arranged on the seat, of which the center is formed with a piercing hole corresponding to the sleeve, in which a ring is provided that extends surrounding the hole and more than one recessed portion are formed inside the fringe of ring; and a button being movable provided in the ring and being joined with the push part, in which more than one raised part corresponding to more than one recessed portion of the ring are provided along the outside of one end of the button and a groove is provided at the other end of the button.

* * * * *